US009875646B2

(12) United States Patent
Schermann et al.

(10) Patent No.: US 9,875,646 B2
(45) Date of Patent: Jan. 23, 2018

(54) APPARATUS AND METHOD FOR SUPERVISING AUDIO SYSTEM DURING BATTERY MODE

(71) Applicant: Siemens Schweiz AG, Zurich (CH)

(72) Inventors: Harald Schermann, Unterschweinbach (DE); Leonid Ayzenshtat, Clarks Summit, PA (US)

(73) Assignee: Siemens Schweiz AG, Zurich (CH)

( * ) Notice: Subject to any disclaimer, the term of this patent is extended or adjusted under 35 U.S.C. 154(b) by 0 days.

(21) Appl. No.: 15/303,595

(22) PCT Filed: Apr. 18, 2014

(86) PCT No.: PCT/US2014/034646

§ 371 (c)(1),
(2) Date: Oct. 12, 2016

(87) PCT Pub. No.: WO2015/160361

PCT Pub. Date: Oct. 22, 2015

(65) Prior Publication Data

US 2017/0032662 A1 Feb. 2, 2017

(51) Int. Cl.

| | |
|---|---|
| ***G08B 7/00*** | (2006.01) |
| ***G08B 29/12*** | (2006.01) |
| ***G08B 29/18*** | (2006.01) |
| ***H04R 29/00*** | (2006.01) |

(52) U.S. Cl.
CPC ..... *G08B 29/126* (2013.01); *G08B 29/181* (2013.01); *H04R 29/007* (2013.01)

(58) Field of Classification Search
None
See application file for complete search history.

(56) References Cited

U.S. PATENT DOCUMENTS

| | | | | |
|---|---|---|---|---|
| 4,037,222 | A | 7/1977 | Solomon | |
| 5,574,423 | A | 11/1996 | Vosika et al. | |
| 2001/0004375 | A1* | 6/2001 | Partyka | H04B 1/7156 375/135 |
| 2003/0169177 | A1* | 9/2003 | Curran | G08B 3/10 340/691.4 |
| 2007/0035407 | A1 | 2/2007 | Capowski et al. | |
| 2009/0009352 | A1 | 1/2009 | Savage et al. | |
| 2014/0340196 | A1* | 11/2014 | Myers | G07C 9/00309 340/5.61 |

OTHER PUBLICATIONS

PCT Search Report dated Jan. 5, 2015, for PCT Application No. PCT/US2014/034646, 10 pages.

* cited by examiner

*Primary Examiner* — Brent Swarthout

(57) ABSTRACT

An approach for supervision of an audio path within an audio system that conserves power while operating in battery mode by temporarily turning off pre-determined audio components of the audio system when not performing supervision tasks and no audio is present on the audio path.

18 Claims, 4 Drawing Sheets

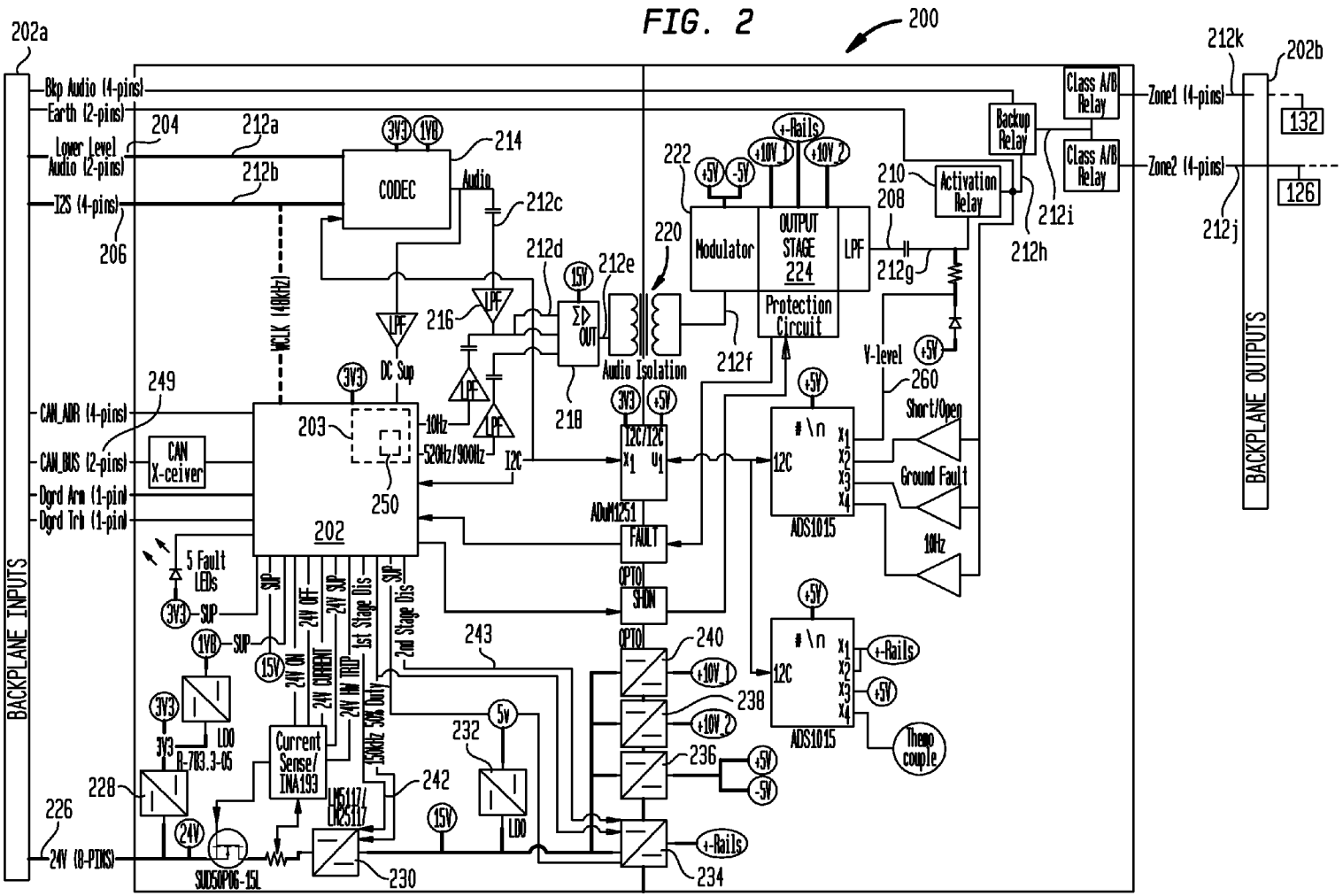
FIG. 2
200
BACKPLANE OUTPUTS
BACKPLANE INPUTS
Zone1 (4-pins)
Zone2 (4-pins)
Class A/B Relay
Backup Relay
Activation Relay
OUTPUT STAGE 224
Protection Circuit
Modulator
LPF
Audio Isolation
Short/Open
Ground Fault
1MHz
Thermocouple
ADS1015
ADuM251
FAULT
SHDN
CODEC
Audio
DC Sup
MCLK (48kHz)
CAN Xceiver
Current Sense/ INA193
LDO
2nd Stage Dis
1st Stage Dis
24V IM TRIP
24V SUP
24V CURRENT
24V OFF
24V ON
5 Fault LEDs
Bkp Audio (4-pins)
Earth (2-pins)
Lower (exp) Audio (2-pins)
TCS (4-pins)
CAN_AUX (4-pins)
CAN_BUS (2-pins)
Dgrd Arm (1-pin)
Dgrd Trk (1-pin)
24V (8-PINS)

APPARATUS AND METHOD FOR SUPERVISING AUDIO SYSTEM DURING BATTERY MODE

FIELD OF THE INVENTION

This application relates to the field of audio systems having a battery mode of operation, and more particularly to apparatuses and methods for supervising an audio system during battery mode of operation.

BACKGROUND

In alarm systems, such as building fire alarm systems, it is desirable to have audio capabilities. Audio capabilities enable emergency messages to be passed between fire control panels and/or audio panels in an alarm system. As public safety is impacted by building alarm systems, standards have been developed by organizations in the United States and Europe.

Some standards, such as UL 864 $9^{th}$ Edition and S527 $3^{rd}$ Edition require the audio paths within fire alarm systems be monitored to assure their operational status and any fault on these systems be announced within 200 seconds. Fire alarm systems are also required to have minimal operation of the audio path within the respective fire alarm system while under battery mode power. However, standards for fire alarm systems do not specify any operational or power requirements while the fire alarm system is not processing an emergency message or corresponding audio through the audio panel of the system either in active or battery mode. Moreover, conventional fire alarm systems don't supervise the respective audio path of the fire alarm system while in battery mode and don't conserve power usage of the fire alarm system. In particular, amplifier cards or units within a fire alarm system consume significant power.

What is needed in the art is an approach that enables monitoring the audio paths internal and external to a fire alarm system in an efficient way while reducing the amount of power consumption required by the fire alarm system including the amplifier unit(s) of such system, especially while operating in battery mode.

SUMMARY

Methods and apparatus consistent with the present invention overcome the inefficient supervision of an audio path within conventional audio systems and advantageously conserve power usage of the audio system by turning off selected components of the audio system during the portion of the supervision cycle period when supervision functions or tasks are not required to be performed and no audio is present on the audio path.

In accordance with methods and systems consistent with the present invention, a method in an audio system is provided for supervising an audio path within the audio system. The audio system has a plurality of operational modes including a battery mode. The method comprising the steps of: determining whether the audio system is in battery mode; in response to determining that the audio system is in battery mode, setting a timer to a time that is less that a predetermined supervision cycle period; activating the timer; performing a supervision function to check an operational status of the audio path; turning off one or more components of the audio system; determining whether the timer is expired; and in response to determining the timer is expired, turning on the one or more components. The method steps may be repeated while the audio system remains in battery mode to continue to conserve power usage.

In one embodiment, the timer is set to a time equal to the predetermined supervision cycle period (e.g., 200 seconds) less a predetermined time for performing the supervision function and other supervision tasks (e.g., 1-20 seconds). For example, in one embodiment, such a method and system advantageously conserves power for 190 seconds of the 200 seconds set as the supervision cycle period or UL requirement for announcing faults within the audio system.

In this embodiment, in response to determining the timer is not expired, the method may further comprise determining whether an audio input is present on the audio path and in response to determining that an audio input signal is present on the audio path, turning on the one or more components again to process the audio input.

Other systems, methods, apparatus, features, and advantages of the present invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

FIG. 2 is a block diagram of a voice amplifier card or apparatus implemented in a fire and voice control panel of FIG. 1 depicted in accordance with an embodiment of the present invention;

DETAILED DESCRIPTION OF THE INVENTION

Figure 1:
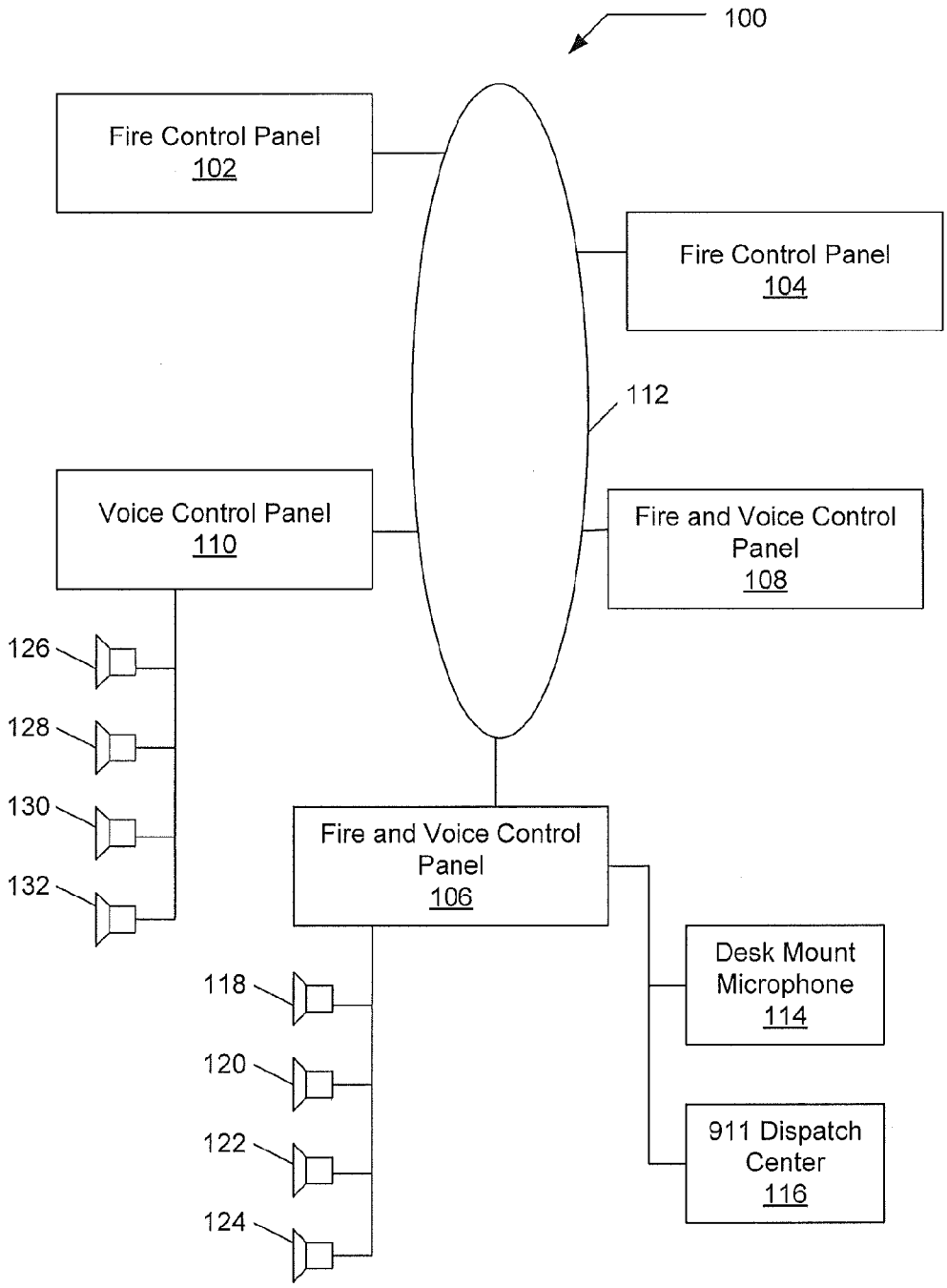
FIG. 1 is an exemplary topology diagram for a building fire alarm system.

An example approach for supervising the audio path within an audio system while conserving power usage during the supervision cycle period is presented. With reference to FIG. 1, an exemplary topology diagram for a building fire and audio alarm system 100 (also referenced as "audio system") is shown. The building fire and audio alarm system may have numerous fire control panels 102 and 104, fire and voice control panels 106 and 108, and voice control panels 110. In other implementations there may be more or fewer devices in the system. In yet other implementations, additional panels such as security panels or HVAC control panels may be present. The panels 102-110 may be networked together by a data network 112. The data network may have a physical layer of wire, radio waves, fiber optic cables, coaxial cable, or a combination of any of the above. Over the physical layer, additional protocol layers may be implemented to carry data, such as a TCP/IP network (commonly called the internet). The data network 112 may be configured as a local area network (LAN) that connects only the panels and building automation systems.

The fire and voice control panel, such as fire and voice control panel 106, may have associated desk mounted microphones 116 and connections to emergency centers, such as a 911 dispatch center 116. Additionally, the fire and voice control panel 106 (or the voice control panel 110 that is separate from and in communication with a fire control panel 102 or 104) may have audio outputs for connection to speakers, such as speakers 118-132 or amplifiers (not shown in FIG. 1). In other implementations, the desk microphone may be an internal microphone or other audio input device.

Turning to FIG. 2, a voice amplifier card or apparatus 200 (also referenced as a "amplifier apparatus") is depicted that may be implemented in a fire and voice control panel 106 or voice control panel 110 in accordance with an embodiment of the present invention. In the implementation shown in FIG. 2, the amplifier apparatus 200 is depicted as having a backplane inputs interface 202*a* and a backplane outputs interface 202*b* for installation in a card cage (not shown in the figures) of the panel 106 or 107. However, the amplifier apparatus 200 may be housed in its own enclosure where the backplane inputs interface 202*a* and the backplane outputs interface are connectors affixed to the enclosure. Although the amplifier apparatus 200 is described as embodied in fire and voice control panel 106 or voice control panel 110 of a building fire and audio alarm system 100, the amplifier apparatus 200 may be employed in other audio systems without departing from the invention. Certain components of an amplifier apparatus 200 are not shown and others not described in detail to provide clarity to and avoid obscuring the invention.

As shown in FIG. 2, the amplifier apparatus 200 includes a processor 202 that may include internal memory 203 for storing program instructions and data for performing processes as described herein. The memory 203 may also store metrics and operational data for the amplifier apparatus operation as part of the system 100. The memory 203 may be implemented external to and in communication with the processor 202 as an electronic non-volatile computer storage device that can be electrically erased and reprogrammed (i.e., flash memory) via the processor 202. In other implementations, other types of memory such as RAM, DRAM, SDRAM, and EEPROM may be employed. Although amplifier apparatus is shown as having a single processor, it will be apparent to those skilled in the art that methods consistent with the present invention operate equally as well with a multi-processor environment.

The amplifier apparatus 200 may also include as analog audio input 204 to receive an audio analog signal (such as from microphone 114) and/or a digital audio input 206 for receiving a digitally stored voice message to be processed by the processor 202 of the amplifier apparatus 200 for transmission to speakers 126-132. In the implementation shown in FIG. 1, the digital audio input 206 is an I2S audio bus (also called $I^2S$, Inter-IC Sound, Integrated Interchip Sound, or IIS) that includes a bit clock line, a word clock line, and at least one multiplexed data line. The I2S audio bus may also include a master clock and a multiplexed data line for upload. Typically the I2S bus carries PCM digital audio data or signals. The I2S allows two channels to be sent on the same data line. The two channels are commonly called right (R) channel and left (L) channel. The word clock is typically a 50% duty-cycle signal that has the same frequency as the sample frequency. The I2S audio bus is defined by the Philips Semiconductor I2S bus specification (February 1986, revised Jun. 5, 1996).

The amplifier apparatus also includes an audio output 208 and a switch 210 that couples the audio output 208 to a speaker 126, 128, 130 or 132 of the audio system 100 when the switch 210 is activated by the processor 202. In the implementation shown in FIG. 2, the amplifier apparatus 200 has an audio path 212 extending from the respective audio input to the audio output 208 when the switch 210 is deactivated and further extending to the speaker 126, 128, 130 or 132 when the switch 352 is activated. The audio path 212 may have audio path segments (e.g., 212*a*, 212*c*, 212*d*, and 212*e* between analog audio input 204 and audio output 208 or 212*b*, 212*c*, 212*d* and 212*e* between digital audio input 206 and audio output 208) that are connected via one or more components of the amplifier apparatus coupled to the audio path 212. These components that are coupled to the audio path 212 may be powered on and off by the processor 202 (e.g., each component has an on state and an off state) to conserve power when the processor is not processing an audio input signal or performing supervision tasks of the audio path 212. In the implementation shown in FIG. 2, the components coupled to audio path 212 may include an ADC DAC codec 214 (e.g., to convert digital audio inputs on I2S bus to an analog form), one or more low pass filters 216, a multiplexer 218 in the event that the processor 202 may select to supply a pre-defined audio signal rather than an audio signal received via inputs 204 or 206, an audio isolation transformer 220, a modulator 222, and an audio amplifier output stage 224 that boosts or amplifies an audio signal for output to audio output 208 when power is supplied to the output stage 224 as further explained herein.

The amplifier apparatus has a power input 226 operatively connected to a power source. In the implementation shown in FIG. 2, the amplifier apparatus 200 receives a DC power signal (e.g., 24 VDC) via the power input 226 from the voice control panel 110 or fire and voice control panel 106 or 108 where the amplifier apparatus 200 is employed. In other implementations, the amplifier apparatus 200 may receive an AC power signal via power input 226 and convert the AC power signal to a first DC power signal. In either implementation, the amplifier apparatus further includes voltage converters 228, 230, 232, 234, 236, 238 and 240 that are coupled to the power input 226 to step down the received DC power signal to DC signal and current levels for supplying power to components of the amplifier apparatus 200 that are coupled to the audio path 212, including the audio amplifier output stage 224.

In the implementation shown in FIG. 2, voltage convertor 230 is a first stage power circuit that converts the received DC power signal to a first stage DC level (e.g., 15 V) for supplying power to one or more additional voltage convertors 232, 234, 236, 238 and 240 that comprise audio output power components. In this implementation, the voltage converter 230 may be a buck convertor that functions as a first stage driver for supplying power to the audio amplifier output stage 224. The processor 202 is operatively coupled to the voltage converter 230 to selectively turn on or off the voltage convertor 230 (for controlling the first stage driver of the audio amplifier output stage 224) via a power activation input 242 of the voltage convector 230.

One or more of the voltage convertors 232, 234, 236, 238 and 240 that receive power from the first stage power circuit (e.g., voltage convertor 230) define a second stage power circuit that converts the received first stage DC level to second stage DC levels (e.g., +/−rail VDC, +/−10 VDC, +/−5 VDC) for supplying power to the modulator 222 and audio amplifier output stage 224, which are both coupled to the audio path 212. The processor 202 is operatively coupled to at least one of the voltage converters (e.g., 234 in FIG. 2) that define the second stage power circuit to selectively turn on or off such voltage convertor(s) via a corresponding activation signal 243 for the respective voltage convertor of the second stage power circuit.

As described in further detail herein, the amplifier apparatus 202 may also include an output feedback 260 coupled between the audio output 208 and the processor 202 that enables the processor 202 to check the voltage level on the audio output 208 is approximately zero before disconnecting the speakers from the audio output 208 and turning off selected audio output power components.

The processor 202 has a plurality of operational modes including a normal mode and a battery mode. The processor 202 operates in the normal mode to process audio input signals present on the audio inputs 204 or 206 until it receives a message or signal from a fire control panel 102, 104 (directly or through a controller in the panel 106, 108 or 110 where the amplifier apparatus 202 is employed) to switch to battery mode of operation based a main power source failure for the system 100. In one implementation, the amplifier apparatus 202 may have a communication bus input 249 (such as a standard controller area network (CAN) bus) to receive messages from the fire control panel 102, 104 or the panel 106, 108 or 110 where the amplifier apparatus is employed. Alternatively, the amplifier apparatus 202 may have a signal input (not shown in FIG. 2) for receiving a battery mode command or identification.

As described herein, the processor 202 is coupled directed or indirectly to each of the audio inputs 204 and 206 and the one or more components coupled to the audio path 212 to be selectively turned on or off in order to effectively conserve power while the amplifier apparatus 202 is in battery mode of operation and not performing supervision functions or tasks during a supervision cycle of the audio path 212.

To manage power savings while still performing supervision functions, the amplifier apparatus 200 also includes a timer 250 that may be internal to the processor 202 (such as a software timer stored in memory 203) or a discrete timer component that is coupled to the processor. As explained in further detail herein, the timer 250 is set to a time that enables the audio system 100 to conserve power usage while still complying with UL standards that require an audio system to be monitored or supervised for integrity (i.e., an operational status where no fault is detected on an audio path or components coupled to the audio path) and that any fault on the audio system be announced within 200 seconds of detection. Accordingly, in one embodiment, the processor sets the timer 250 to a time (z) that is equal to the predetermined supervision cycle period (y) less a predetermined time for performing the supervision function (x) or tasks for checking the integrity of the audio path 212 and components (e.g., modulator 222 and audio amplifier output stage 224) coupled to or within the audio path 212. In this embodiment, if the predetermined supervision cycle period (y) is 200 seconds and the predetermined time for performing supervision function or tasks (x) is 10 seconds, the processor sets the timer 355 for 190 seconds (e.g., z=y−x).

Figure 3A:
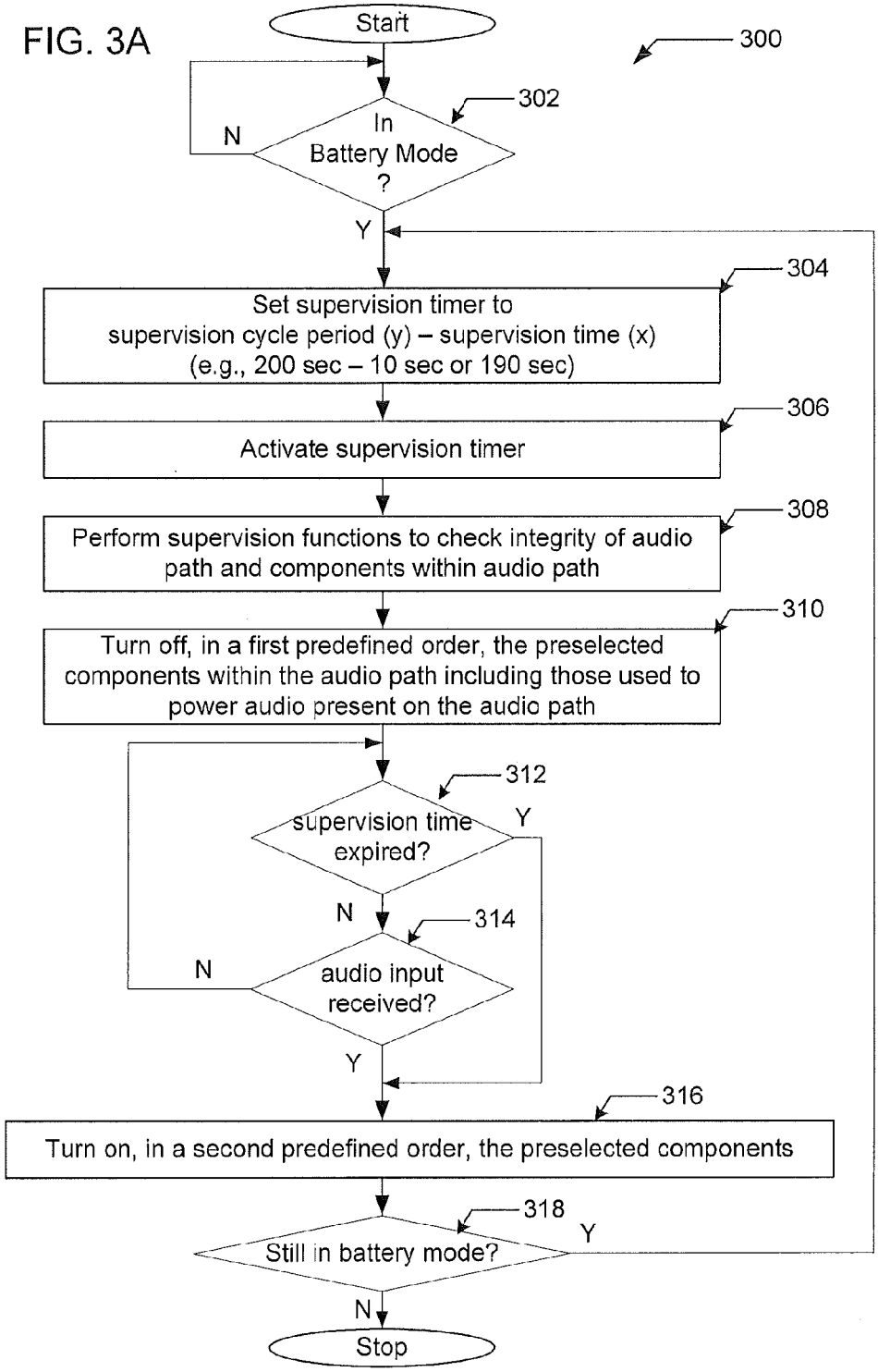
FIG. 3A illustrates a flow diagram for a process performed in the voice amplifier apparatus for supervising an audio path within the apparatus while limiting power usage in accordance with an embodiment of the invention.

Turning to FIG. 3A, a flow diagram is shown for a process 300 performed in the voice amplifier apparatus 200 of the audio system 100 for supervising an audio path within the apparatus while limiting power usage in accordance with an embodiment of the invention. Initially, the processor 202 determines whether the audio system 100 is in battery mode (step 302). In one implementation, the processor 202 determines the audio system 100 is in battery mode by recognizing a corresponding operational mode change message or signal input from the fire control panel (e.g., via communication bus input 249) that reflects that the main power source has failed and to operate in the battery mode. Alternatively, in another implementation in which the amplifier apparatus receives input power from a mains power source and has an alternate battery source (not shown in figures), the processor may automatically detect to operate in battery mode when power (or current) from the mains power source is no longer received. If it is determined that the audio system is not in battery mode, the processor 202 may continue to check for an operation mode change signal input or mains power source input while performing other tasks in parallel in normal operational mode.

In response to determining that the audio system is in battery mode, the processor 202 sets the timer 250 to a time (z) that is less that a predetermined supervision cycle period (y) (step 304) before performing the following steps or tasks: activate the timer (step 306); perform a supervision function to check the integrity or an operational status of the audio path and components within the audio path (step 308); and turns off, in a first predefined order, one or more preselected components of the audio system including those components used to power or amplify audio present on the audio path. (step 310).

In one embodiment, when performing step 304, the processor 202 sets the timer 250 to a time (z) that is equal to the predetermined supervision cycle period (y) less a predetermined time for performing the supervision function (x) or tasks in steps 304, 306, 308 and 310.

Figure 3B:
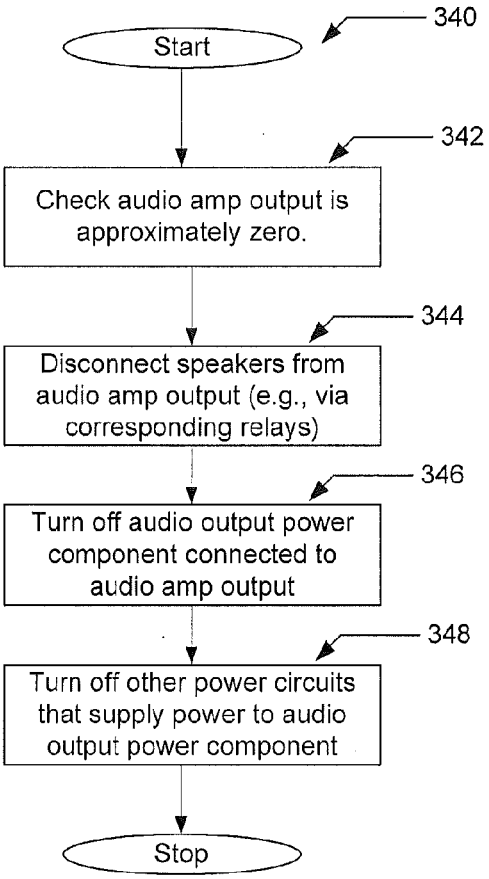
FIG. 3B illustrates a flow diagram for a process performed in the voice amplifier apparatus for turning off pre-selected components of the voice amplifier apparatus in a first predefined order to limit power usage within a supervision cycle period in accordance with an embodiment of the invention.

Turning briefly to FIG. 3B, a flow diagram for an exemplary process 340 is shown that may be performed in the voice amplifier apparatus 202 for turning off pre-selected components of the voice amplifier apparatus 202 in a first predefined order to limit power usage within a supervision cycle period in accordance with an embodiment of the invention. The processor 202 may first determine if the audio output 208 has a voltage level that is approximately zero by monitoring the output feedback 260 (step 342). In one implementation, the processor 202 waits for proceeding to step 244 until the output feedback 260 is approximately zero. The processor 202 then disconnects the speakers 126, 128, 130 or 132 from the audio output 208 by deactivating switch 210. Next, the processor 202 turns off the audio output power component (e.g., audio amplifier output stage 224) that is coupled to the audio output 208 by deactivating at least one of the voltage converters (e.g., 234 in FIG. 2) that define the second stage power circuit. After turning off power to such audio output power component, the processor 202 turns off the first stage power circuit (e.g., voltage converter 230) that supplies power to the second stage power circuit by deactivating the power activation input 242 of the first stage power circuit.

Returning to FIG. 3A, after turning off the preselected components of the audio system, the processor 202 determines whether the timer 250 is expired (step 312). If the timer 250 is not expired, the processor 202 determines whether an audio input signal has been received or is present on the audio input 204 or 206. If no audio input signal has been received or is present on the audio input, the processor 202 continues processing at step 312.

Figure 3C:
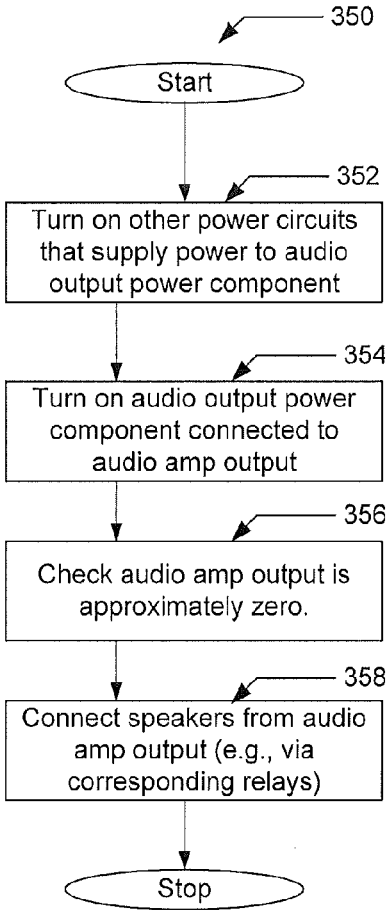
FIG. 3C illustrates a flow diagram for a process performed in the voice amplifier apparatus for turning on the pre-selected components of the voice amplifier apparatus in a second predefined order within the supervision cycle period in accordance with an embodiment of the invention.

In response to determining the timer is expired or that an audio input signal has been received or is present on the audio input, the processor 202 turns on the preselected components in a second predefined order that is different from the first predefined order (step 316). As shown in FIG. 3C, the processor 202 turns on the first stage power circuit (e.g., voltage converter 230) that supplies power to the second stage power circuit (e.g., voltage converter 234) in step 352; and then turns on (e.g., audio amplifier output stage 224) that is coupled to the audio output 208 by activating at least one of the voltage converters (e.g., 234 in FIG. 2) that define the second stage power circuit (step 354). The processor 202 may next determine if the audio output 208 has a voltage level that is approximately zero by monitoring the output feedback 260 (step 342). If the voltage level of the audio output 208 is approximately zero, the processor 202 activates the switch 210 to connect the speaker(s) to the audio output 208.

Returning again to FIG. 3A, after turning on the preselected components, the processor 202 determines whether the audio system 100 is still in battery mode (step 318). If still in battery mode, the processor 202 continues processing at step 304 to repeat the process for supervising the audio path 212 within the apparatus 202 while limiting power usage as described in detailed herein. If it determines that the system 100 is no longer in battery mode, then the processor 202 ends process 300 and returns to normal operational mode.

The foregoing detailed description of one or more embodiments of the supervision of audio path of an audio system during battery mode to limit power usage has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. A method in an audio system for supervising an audio path within the audio system, the audio system having a plurality of operational modes including a battery mode, the method comprising the steps of:

determining whether the audio system is in battery mode;

in response to determining that the audio system is in battery mode, (a) setting a timer to a time that is less that a predetermined supervision cycle period;

(b) activating the timer;

(c) performing a supervision function to check an operational status of the audio path;

(d) turning off one or more components of the audio system;

determining whether the timer is expired; and in response to determining the timer is expired, turning on the one or more components.

2. The method of claim 1, wherein in step (a) the timer is set to a time equal to the predetermined supervision cycle period less a predetermined time for performing the supervision function.

3. The method of claim 1, wherein in step (a) the timer is set to a time equal to the predetermined supervision cycle period less a predetermined time for performing each of steps (a), (b), (c) and (d).

4. The method of claim 1, wherein the step (c) of performing the supervision function further comprises checking an operational status of the one or more components of the audio system.

5. The method of claim 1 where the step (d) of turning off one or more components further comprises:

turning off, in a first predefined order, a plurality of the components of the audio system that are within the audio path.

6. The method of claim 5, wherein:

the audio system comprises an amplifier unit having the plurality of the components that are within the audio path;

one of the plurality of components of the amplifier unit is an audio output power component coupled to an audio output of the amplifier unit;

another of the plurality of components of the amplifier unit is a power circuit that supplies power to the audio output power component; and the step of turning off, in a first predefined order, further comprises:

(d1) disconnecting a speaker from the audio output of the amplifier unit;

(d2) turning off the audio output power component; and (d3) turning off the power circuit after performing step (d2).

7. The method of claim 5, wherein the step of turning on the one or more components further comprises:

turning on, in a second predefined order, the plurality of the components of the audio system that are within the audio path.

8. The method of claim 7, wherein the step of turning on, in a second predefined order, further comprises:

turning on the power circuit;

turning on the audio output power component; and connecting the speaker from the audio output of the amplifier unit.

9. The method of claim 1, further comprising:

in response to determining the timer is not expired, determining whether an audio input signal is present on the audio path;

in response to determining that an audio input signal is present on the audio path, turning on the one or more components.

10. An amplifier apparatus for an audio system, comprising:

an audio input;

an audio output;

a timer;

a switch that couples the audio output to a speaker of the audio system when the switch is activated;

an audio path extending from the audio input to the audio output when the switch is deactivated and further extending to the speaker when the switch is activated;

one or more components coupled to the audio path where each of the one or more components has an on state and an off state; and a processor having a plurality of operational modes including a battery mode, the processor being coupled to the audio input, audio output, the audio path, and the one or more components;

wherein the processor determines whether to operate in the battery mode;

in response to determining to operate in the battery mode, the processor (a) sets the timer to a time that is less that a predetermined supervision cycle period;

(b) activates the timer;

(c) performs a supervision function to check integrity of the audio path;

(d) turns the one or more components to the off state;

(e) determines whether the timer is expired; and (f) in response to determining the audio system is expired, turns the one or more components to the on state.

11. The amplifier apparatus of claim 10, wherein in step (a) the timer is set to a time equal to the predetermined supervision cycle period less a predetermined time for performing the supervision function.

12. The amplifier apparatus of claim 10, wherein in step (a) the timer is set to a time equal to the predetermined supervision cycle period less a predetermined time for performing each of steps (a), (b), (c) and (d).

13. The amplifier apparatus of claim 10, wherein, when performing the supervision function, the processor checks integrity of the one or more components.

14. The amplifier apparatus of claim 10, wherein:

a plurality of the components are coupled to the audio path;

one of the plurality of components is an audio output power component coupled to the audio output of the amplifier apparatus;

another of the plurality of components is a power circuit that supplies power to the audio output power component; and the processor turns each of the plurality of components to the off state in a first predefined order.

15. The amplifier apparatus of claim 14, wherein:

when turning each of the components to the off state in the first predefined order, the processor:

(d1) deactivates the switch to disconnect the speaker from the audio output;

(d2) turns off the audio output power component (d3) turns off the power circuit after performing step (d2).

16. The amplifier apparatus of claim 10, wherein, when turning on the one or more components, the processor turns on a plurality of the components in a second predefined order that is different than the first predefined order.

17. The amplifier apparatus of claim 16, wherein, when the processor turns on the plurality in the second predefined order, the processor;

turns on the power circuit;

turns on the audio output power component; and activates the switch to connect the speaker to the audio output.

18. The amplifier apparatus of claim 1, further comprising:

in response to determining the timer is not expired, the processor determines whether an audio signal is present on the audio input;

in response to determining that an audio signal is present on the audio input, turns on the one or more components.

* * * * *